United States Patent [19]

Graf Vom Hagen

[11] 4,110,667

[45] Aug. 29, 1978

[54] PROCESS FOR CLEANING SPARK PLUGS ON INTERNAL COMBUSTION ENGINES

[75] Inventor: Siegbert Graf Vom Hagen, Bensheim, Fed. Rep. of Germany

[73] Assignee: Kyberna GmbH, Bensheim, Fed. Rep. of Germany

[21] Appl. No.: 599,667

[22] Filed: Jul. 28, 1975

[30] Foreign Application Priority Data

Aug. 2, 1974 [DE] Fed. Rep. of Germany ..... 2437257

[51] Int. Cl.[2] ..... H01T 13/20

[52] U.S. Cl. ..... 313/143; 313/138; 313/139; 29/25.12

[58] Field of Search ..... 313/143, 142, 149, 138, 313/139; 29/25.12

[56] References Cited

U.S. PATENT DOCUMENTS

| | | | |
|---|---|---|---|
| 1,962,669 | 6/1934 | Parkin | 313/142 X |
| 2,182,061 | 12/1939 | Sparkes | 313/11.5 |
| 3,046,435 | 7/1962 | Campbell | 313/143 |
| 3,599,030 | 8/1971 | Armstrong | 313/141 |
| 3,825,784 | 7/1974 | Lindsay | 313/143 X |

*Primary Examiner*—Rudolph V. Rolinec
*Assistant Examiner*—Darwin R. Hostetter
*Attorney, Agent, or Firm*—Stevens, Davis, Miller & Mosher

[57] ABSTRACT

A spark plug for internal combustion engines having a center electrode, a ceramic insulator body and metal sleeve around the body. The sleeve defines an annular outside electrode around the center electrode with a concave depression in the insulator between the electrodes. The plug is operated at high current and voltage so that a high intensity spark will burn off any combustion residue on the relatively small insulator area between the electrodes. A process for removing combustion residues using this spark plug is also disclosed.

10 Claims, 7 Drawing Figures

PROCESS FOR CLEANING SPARK PLUGS ON INTERNAL COMBUSTION ENGINES

The present invention relates to a process for removing combustion residues from the ceramic insulator body of spark plugs for internal combustion engines. These combustion residues, particularly carbon and possibly metallic lead and lubricating oil can form a shunt of very low resistance across the spark plug.

As is known in the prior art spark plugs have an insulator body which is made in such a manner that it heats up in operation due to the heat produced upon the combustion. By changing the structure of the spark plug, a smaller or larger part of the heat is removed as a result of which the temperatures of the insulating body changes, resulting in different operating conditions of the engine. Accordingly, the known spark plugs differ by different heat values. The temperatures established are so selected that optimum burning off is reached for a given condition of operation while in other conditions of operation the burn-off is less. When using leaded gasoline a residue having a high percentage of lead can form on the insulator body and in unfavorable cases may make the spark plugs unusable since a shunt of very low resistance which cannot be eliminated is produced.

The object of this invention is to produce a spark plug and to operate it in combination with the ignition system in such a way that any residue formed or deposited residues are practically completely eliminated during operation by the ignition spark.

To achieve this, the spark produced by an ignition current of about 70mA, with an electrode spacing of about 1mm or more and an ignition voltage of about 20kV or higher is, in the process in accordance with the invention, deflected by means of the flow of gas or air occurring in the engine cylinder or combustion space towards the end of the insulator body and passes over it. The insulator body is maintained approximately at the temperature of the engine coolant by a metal sleeve surrounding it and either contacting it or separated from it only by a very thin air gap. This sleeve has the fastening thread on its outer side.

To carry out the new process therefore a much higher ignition energy is necessary than that supplied by most of the ordinary ignition systems. An ignition system which can produce voltages and currents of the type indicated is described in German Offenlegungsschrift 2,340,865. With respect to the spark plug itself the insulator body of the present invention differs from the insulator bodies of known spark plugs because it does not have the relatively large distance between the outer surface of the insulator body and the inner surface of the metal sleeve which bears the thread. By the selection of a small gap or of dimensions in connection with which a gap is eliminated, two advantages accrue: the desired cooling of the insulator body is facilitated and the surface area upon which deposits are produced (in known spark plugs on the entire so-called neck) is substantially reduced. The combustion residues can deposit only in the region of the end surface.

It is advantageous to develop the spark plug used for the carrying out of the new process so that the surface of the ceramic insulator body is provided in the region between the center electrode and the annular outside electrode with a groove-like depression the edges of which extend up to these electrodes and which is defined in cross-section by a circular segment or a curve. For example, the cross-section of the groove can also be defined by a segment of a parabola.

With reference to the existing conditions of flow in the engine cylinder of combustion space it may be advisable to provide recesses in the ring electrode or to provide the ring-shaped electrode with projections which are uniformly distributed on its periphery, for instance four, six, or eight projections. The projections can lie in a plane transverse to the longitudinal axis of the spark plug or form an acute angle with the longitudinal axis. These projections, which may be connected for instance by welding or soldering may be of a different material than the ring.

Instead of the ring-shaped outside electrode one can also provide a so-called roof electrode. In this embodiment, the end surface of the ceramic insulator body is preferably made so that its outer edge extends beyond the center electrode. In this way the deflection of the spark towards the surface to be cleaned is favored.

Various illustrative embodiments of the subject matter of the invention are shown in the drawing in which.

Figure 1:
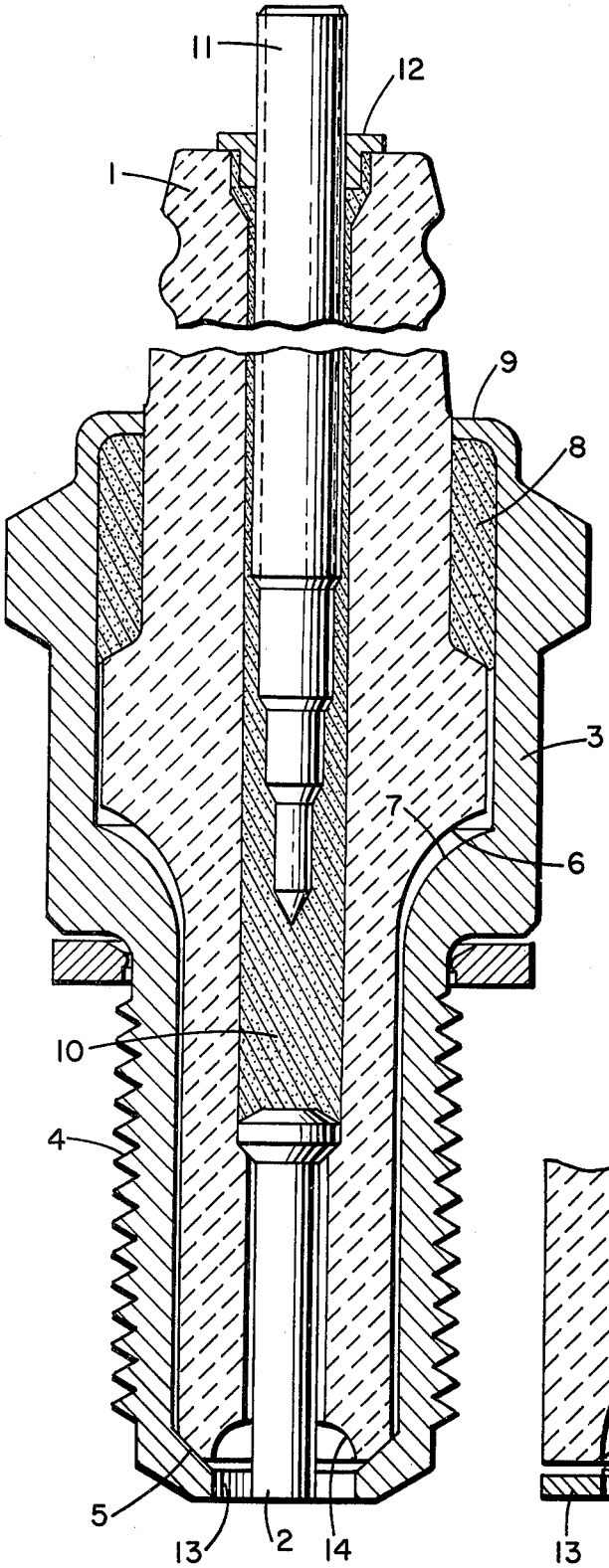
FIG. 1 shows diagrammatically a spark plug in longitudinal section, partially broken away.

Referring now to the drawings in greater detail, FIG. 1 shows the insulator body 1 in section along the plane of the central electrode 2 with the body 1 surrounded by a metal sleeve 3 bearing the threads 4. It is advisable to make the air gap between the insulating body 1 and the metal sleeve 3 as small as possible or to so select the fit that the outer surface of the insulating body 1 and the inner surface of the metal sleeve 3 contact each other.

In the embodiment shown, the conical edge 5 of the front surface of the insulating body 1 rests against a corresponding surface on the metal sleeve 3. The assembling can also be effected in such a manner that the surfaces 6 and 7 of the ceramic body and of the metal sleeve 3 respectively rest against each other, possibly with a packing between them. In such case there is a gap at the front surface of the insulating body 1 between the latter and the metal sleeve 3 as a result of which the conditions of flow can be improved. Numeral 8 refers to the sealing composition for the sealing of the insulating body 1 in the metal sleeve 3. The section 9 of the metal sleeve 3 is beaded over after the sealing composition 8 has been put in place. The center electrode 2 is sealed off by the electrically conductive sealing composition 10, the mandril 11 and the ring 12.

The part of the metal sleeve 3 which is marked 13 is the ring electrode. The insulator body 1 is limited at its end surface 14 as seen in cross-section by a circular-like curve.

Figure 2:
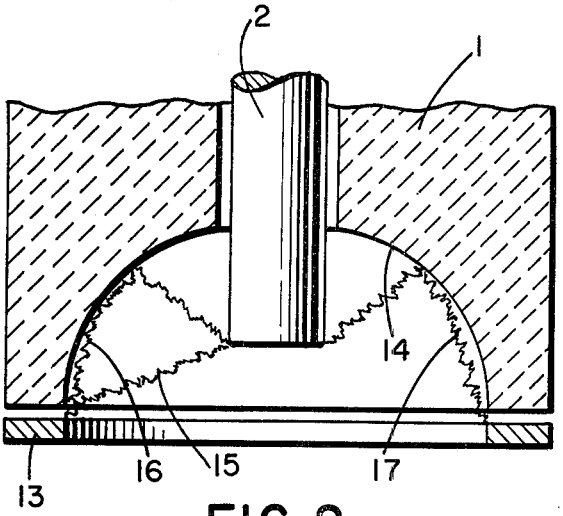
FIG. 2 is a cross-section through the front end of a spark plug on a larger scale than in FIG. 1.

FIG. 2 shows on a larger scale and in fragmentary view the cleaning action of the formation of the arc. The ceramic body 1 is concave at its end surface 14 by virtue of the aforementioned shaping of the cross-section. The center electrode 2 extends beyond the bottom of the concave recess 14. At the upper outer edge of the recess 14 there is located the outside electrode 13. The arc 15 produced by the relatively large ignition energy is deflected by the flow of gas or air in the combustion chamber so that the arc assumes the course shown at 16 and 17.

Figure 3:
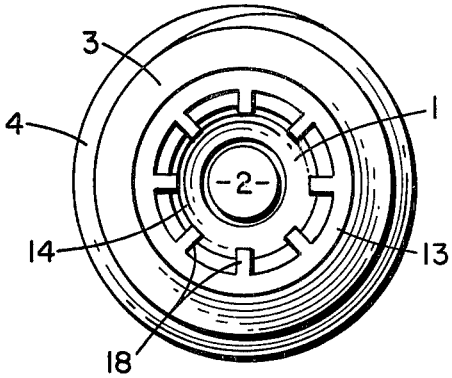
FIGS. 3 and 4 are a plan view and longitudinal section respectively of a ring electrode with projections.
Figure 4:
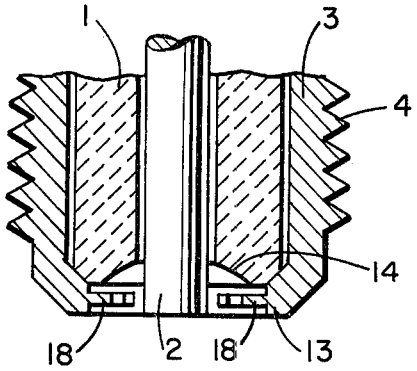

The outside electrode 13 shown in FIGS. 3 and 4 has inward-extending projections 18 distributed uniformly over its periphery; these projections can be shaped as inwardly projecting pins. As a result of electrical influences and flow effects, the arc is developed between the center electrode 2 and various projections 18 in such a manner that the arc reaches all projections 18 upon one or several cycles of the engine.

Figure 5:
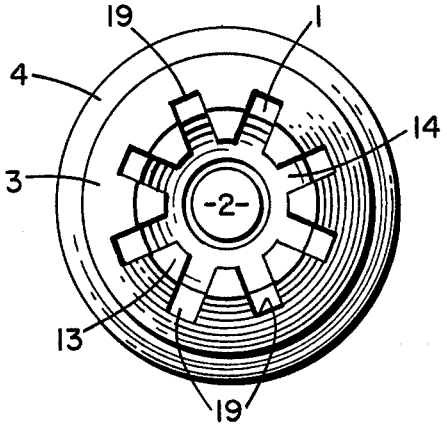
FIGS. 5 and 6 are a top view and longitudinal section respectively of a ring electrode with recesses.
Figure 6:
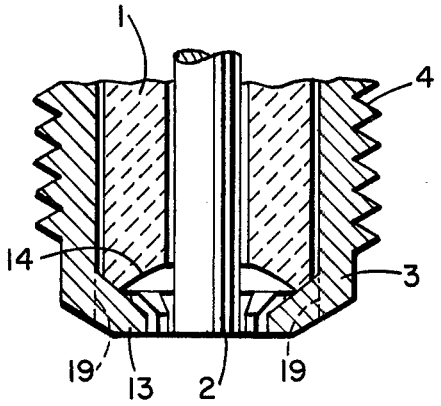

FIGS. 5 and 6 are a top view of an outside electrode 13, similar to that shown in FIG. 1, but with recesses 19. These recesses facilitate a strong flow of air or gas which deflects the arc in the desired manner.

By the provision of projections or recesses, the admission of the mixture to the arc can also be favored.

Figure 7:
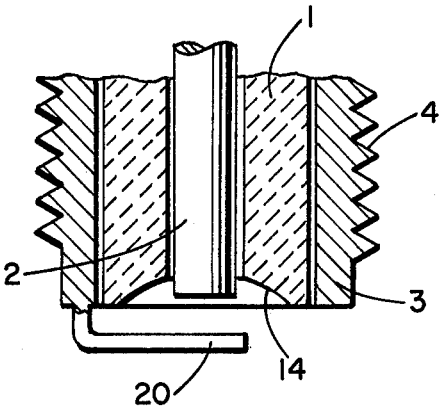
FIG. 7 shows a roof electrode in longitudinal section.

The cleaning deflection of the arc can also be obtained with a spark plug which does not have an annular outside electrode, but the generally customary roof electrode, as shown in FIG. 7.

The upper edge of the recess 14 of the insulator body 1 lies somewhat higher than or protrudes beyond the end of the center electrode 2. 20 is the roof electrode which extends downward from and radially inwardly of the sleeve 3.

The upper values for ignition current and ignition voltage are determined by the structural shape of the electrode, the electrode spacing and the quantity and distribution of the deposits as well as the size of the required deflection of the arc; they can be determined in operation. Thus, for instance, voltages of up to 100 kV and currents of up to 150mA can be used in individual cases.

A spark plug operated and constructed in accordance with the present invention has in particular the advantage that the cleaning action is present in all operating conditions. This spark plug can thus be used universally under the conditions indicated. The problems of heating of the insulating body of known spark plugs (designated by the heat value) no longer presents any difficulty in the spark plug of this invention. The cleaning and burning-off action of the heated insulating body is unnecessary. Cleaning is effected solely by the action of the arc acting on the combustion residues.

An additional advantage of this invention is that the occurrence of a leakage current (shunt) through the layer of combustion residues forming between the center electrode and the outside electrode is no longer a problem in the spark plug of this invention. This condition cannot occur in case of proper operation since the particles of residue are struck by the arc upon or shortly after depositing on the insulating body and are burned off.

What is claimed is:

1. A spark plug comprising:

(a) an elongated insulator body having a center electrode passing therethrough and a metal sleeve surrounding the insulator body over a major portion of its length and in good heat conducting relationship therewith, said metal sleeve contacting the outside of the insulated body;

(b) an outside annular electrode spaced from the end of the center electrode to define a spark gap therebetween; and (c) a depression in said insulator body between the electrodes, said depression having a concave shape in a cross-section parallel to the longitudinal axis of the center electrode, said depression located solely within the limits of said insulator body and said metal sleeve having a shape other than one forming a contiguous line with said depression, the surface of said depression being below the line directly connecting the center electrode and the outside annular electrode.

2. The spark plug of claim 1 in which the outside electrode is annular and has projections uniformly about its periphery.

3. The spark plug of claim 1 in which the outside electrode is annular and has recesses uniformly about its periphery.

4. The spark plug of claim 1 in which the metal sleeve has threads on its outer periphery for securing the spark plug in place.

5. The spark plug of claim 1 in which the metal sleeve is spaced from the outside of the insulator body over a major portion of its length by a small air gap.

6. The spark plug of claim 1 in which the curved shape of the depression is parabolic.

7. The spark plug of claim 1 in which the plane of the outside electrode is perpendicular to the longitudinal axis of the center electrode.

8. The spark plug of claim 1 in which the insulator body is retained in the metal sleeve at the end adjacent the spark gap by a conical edge on the insulator body which contacts the inside of corresponding surface of the metal sleeve.

9. The spark plug of claim 1 in which the end of the center electrode protrudes beyond the surface of said depression.

10. A process for removing deposits of combustion residues from the ceramic insulator body of a spark plug located in an engine cylinder during operation of the engine comprising:

(a) producing a spark across a gap of at least one mm with a current of at least 70 mA and a voltage of 20 kV;

(b) deflecting said spark by means of a flow of gas in the engine cylinder combustion space against the end of said insulator body; and (c) maintaining said insulator body at approximately the engine coolant temperature by a sleeve which surrounds it, said sleeve having threads on the outer periphery thereof for securing said spark plug in place, said spark plug further comprising:

(1) an elongated insulator body having a center electrode passing therethrough and a metal sleeve surrounding the insulator body over a major portion of its length and in good heat conducting relationship therewith, said metal sleeve contacting the outside of the insulated body;

(2) an outside annular electrode spaced from the end of the center electrode to define a spark gap therebetween; and (3) a depression in said insulator body between the electrodes, said depression having a concave shape in a cross-section parallel to the longitudinal axis of the center electrode, said depression located solely within the limits of said insulator body and said metal sleeve having a shape other than one forming a contiguous line with said depression, the surface of said depression being below the line directly connecting the center electrode and the outside annular electrode.

* * * * *